US005199783A

United States Patent [19]

Pelton

[11] Patent Number: 5,199,783

[45] Date of Patent: Apr. 6, 1993

[54] FLUORESCENT LIGHTING SYSTEM

[75] Inventor: Bruce A. Pelton, Emeryville, Calif.

[73] Assignee: Lumatech Inc., Emeryville, Calif.

[21] Appl. No.: 921,897

[22] Filed: Jul. 29, 1992

[51] Int. Cl.[5] ..... F21K 7/00

[52] U.S. Cl. ..... 362/260; 362/226; 362/378; 439/615

[58] Field of Search ..... 362/216, 226, 260, 378, 362/376; 439/615

[56] References Cited

U.S. PATENT DOCUMENTS

| | | | |
|---|---|---|---|
| 4,547,839 | 10/1985 | Ripley et al. | 362/216 |
| 4,750,096 | 6/1988 | Lim | 362/218 |
| 5,015,917 | 5/1991 | Nigg | 362/216 X |
| 5,044,974 | 9/1991 | Pelton et al. | 439/307 |

OTHER PUBLICATIONS

Eagle Electric Manuf. Co. Inc. Brochure, "Non-Tamp Type Plug Fuses & Adapters", Eagle 1-5, Eagle Electric Manuf. Co. Inc., Long Island City, N.Y.

*Primary Examiner*—Stephen F. Husar
*Attorney, Agent, or Firm*—Bielen, Peterson & Lampe

[57] ABSTRACT

A lighting system using a PL fluorescent lamp which is capable of screwing into a standard electrical lamp socket utilizing a base member possessing a mechanism for mechanically supporting a PL fluorescent lamp. A male fitting is connected to the base member and includes an outer surface which may be threaded in configuration. An adaptor is also used in the present system and is capable of mechanically and electrically connecting to a standard Edison electrical lamp socket. The adaptor includes an external threaded outer surface for threadingly engaging the standard Edison lamp socket, and also includes an inner surface in the form of a lamp socket. The inner surface lamp socket of the adaptor is capable of mechanically and electrically contacting the outer surface of the male fitting. The adaptor inner lamp socket and male fitting are of a non-standard size. The adaptor locks into the standard Edison electrical lamp socket, preventing its usage by standard incandescent lamp bases.

8 Claims, 2 Drawing Sheets

FLUORESCENT LIGHTING SYSTEM

BACKGROUND OF THE INVENTION

The present invention relates to a novel and useful fluorescent lighting system which precludes the use of incandescent lamps.

Tamper proof fuses and adaptors have been employed in the past to prevent insertion of a coin, such as a one-cent piece, to override the necessity of a fuse. Such devices have never been employed in the lighting field.

The standard incandescent light bulb utilizes a screw-in base, which is referred to in the art as an "Edison" base. The Edison base normally threadingly engages a conventional Edison light bulb socket found in lighting fixtures everywhere. It has long been realized that fluorescent lighting lamps are far and away more efficient than incandescent lamps.

Recent advances in fluorescent lamp production have produced PL lamps which include 2 or 4 envelopes. The lighting levels measured from such PL lamps corresponds to the lighting levels produced by commonly used incandescent lamps.

Reference is made to U.S. Pat. No. 4,750,096 which describes fluorescent lighting fixture which is able to be screwed-in to a standard Edison light socket and, thus, substitute for the incandescent light bulb.

Although such fluorescent lamp units provide lighting at a vastly reduced costs. It should be noted that the PL fluorescent lamp possesses a lamp life of 10 times that of a normal incandescent light bulb. However, each fluorescent unit is initially more expensive than incandescent lamp bulbs and is subject to pilferage and replacement by an incandescent light bulb when the fluorescent unit is removed or expended.

Reference is made to U.S. Pat. No. 5,044,974 that includes a locking mechanism to hold a fluorescent lamp adaptor in a standard socket. Although successful in preventing pilferage, a person possessing the proper tool may still remove the unit and replace the same with an incandescent lamp which is undesirable when energy savings are an overall requirement.

A system which would permit the use of a fluorescent lamp in any standard Edison lamp socket, yet permanently preclude the use of incandescent lamp would be a notable advance in the field of energy conservation.

SUMMARY OF THE INVENTION

In accordance with the present invention a novel and useful fluorescent lighting system is herein provided.

The system of the present invention utilizes a fixed member which is mechanically and electrically connected to a fluorescent lamp. A base member may also be employed to contain an electrical ballast and support a reflector if necessary. In addition, the base member may be used with a ballast which is remotely located relative to the base member. The male fitting is mechanically and electrically connected to the base member. The male fitting includes an outer surface which may have a threaded, bayonet, or other configuration. Such male fitting would be of non-standard size, i.e.: incapable of fitting into a standard Edison lamp socket.

An adaptor is also employed in the present system and is capable of mechanically and electrically fitting into a standard electrical lamp socket. The adaptor possesses an external outer surface which screws into the standard Edison electrical lamp socket. Locking means is provided for preventing the adaptor from being removed or being screwed out of the standard electrical lamp socket. The adaptor is also provided with an internal or inner lamp socket which is capable of mechanically and electrically contacting the outer surface of the male fitting. Needless to say, the inner lamp socket of the adaptor also is of a non-standard size and, thus, is also incapable of accepting the Edison base of a standard incandescent lamp or light bulb.

The male fitting may be fastened to the base member by providing a flange on the male fitting. The flange would engage a shoulder on the base member and be fastened by forming these elements in a unitary fashion, by gluing, and other known fastening means.

It may be apparent that a novel and useful fluorescent system has been herein before described.

It is therefore an object of the present invention to provide a fluorescent lighting system which includes a fluorescent unit which is only capable of fitting into a non-standard socket that has been provided by an adaptor that is permanently connected to a standard Edison socket.

It is another object of the present invention to provide a fluorescent lighting system which includes use of incandescent lamps after alteration of a Edison lamp socket by an adaptor mechanism.

Yet another object of the present invention is to provide a fluorescent lighting system which permanently converts standard lamp sockets to use with fluorescent lighting units.

A further object of the present invention is to provide a fluorescent lighting system which results in vast energy savings once the system is installed in standard lamp sockets.

The invention possesses other objects and advantages especially as concerns particular characteristics and features thereof which will become apparent as the specification continues.

For a better understanding of the invention reference is made to the following detailed description of the preferred embodiments which should be referenced to the hereinabove described drawings.

DESCRIPTION OF THE PREFERRED EMBODIMENTS

Various aspects of the present invention will evolve from the following detailed description of the preferred embodiments thereof which should be referenced to the prior described drawings.

Figure 4:
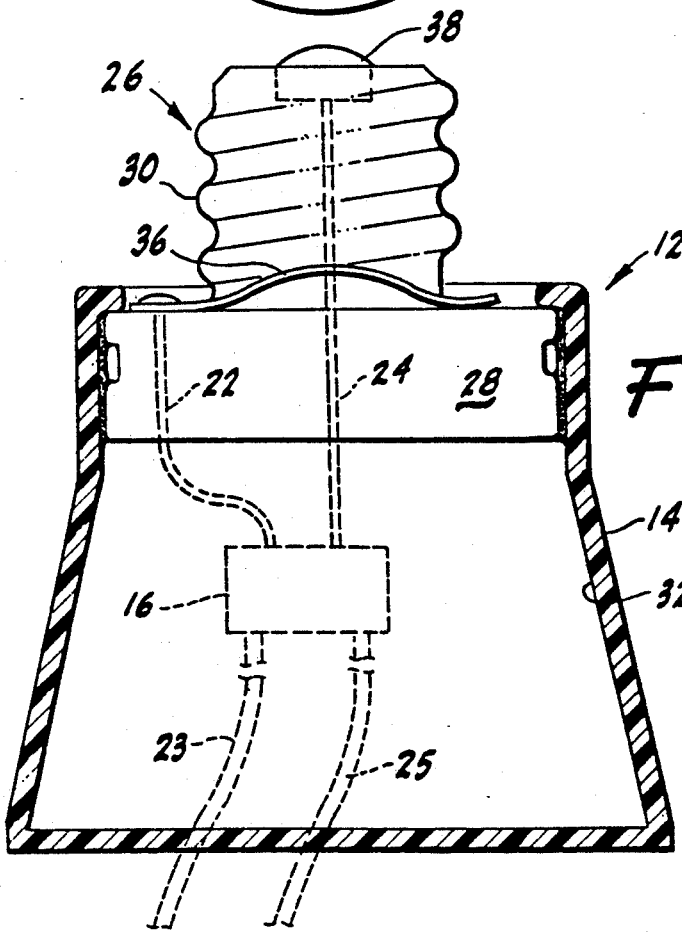
FIG. 4 is a sectional view depicting the base unit and male fitting used in conjunction with the fluorescent lamp, the connecting element of which is depicted in phantom.
Figure 5:
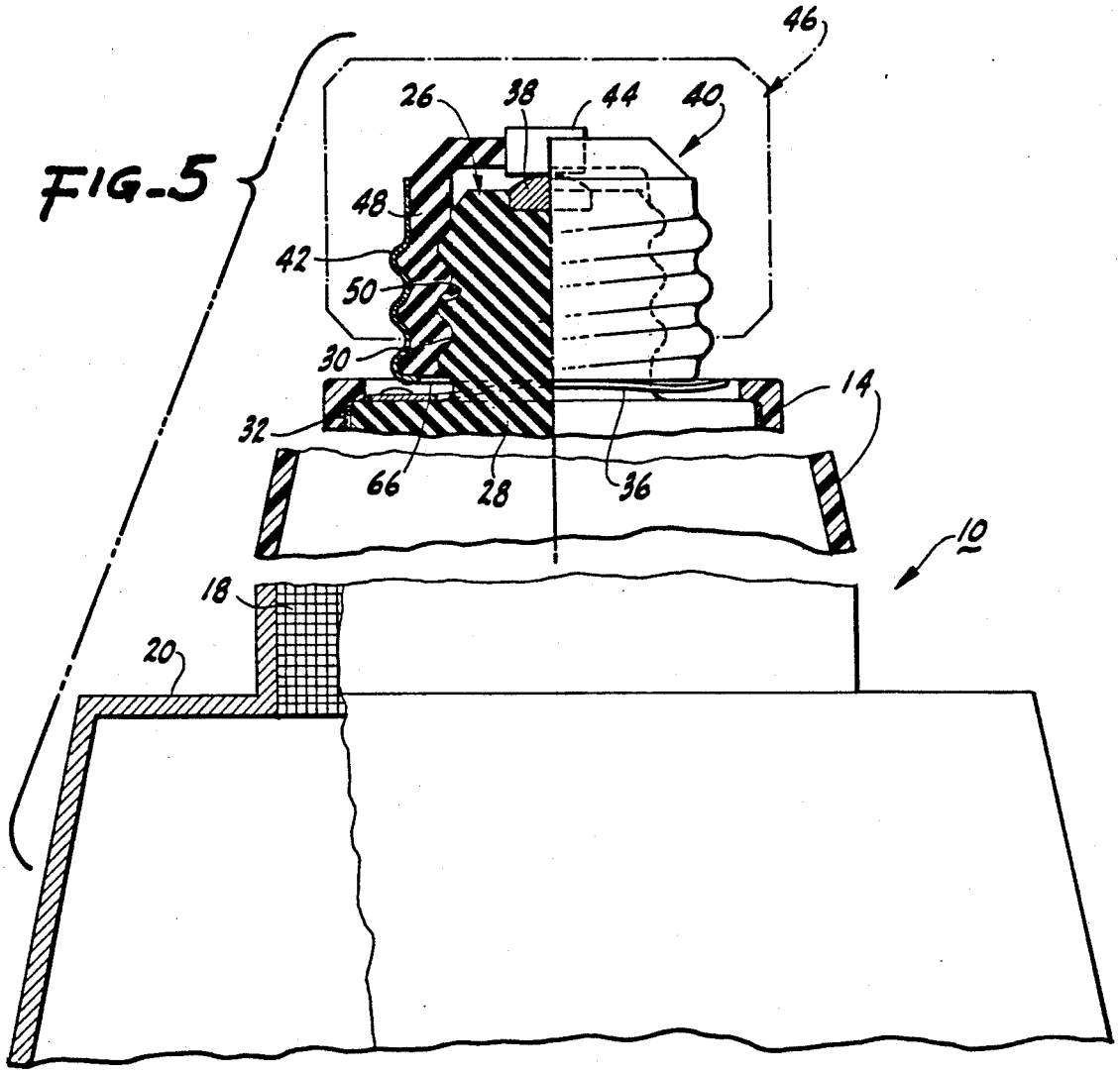
FIG. 5 is a side elevational view of a portion the base unit and male fitting in phantom connected therewithin, and the adaptor unit fixed within a standard Edison base shown schematically, as well as a connected ballast and reflector, also shown schematically.

The system as a whole is depicted in the drawings by reference character 10, FIG. 5. Fluorescent lighting system 10 includes as one of its elements a base member 12, FIG. 4 which includes an outer shell 14 formed of material such as plastic and the like.

Shell 14 normally includes an attached connecting element 16 (shown schematically) for mechanically and electrically connecting a PL lamp of the type shown in U.S. Pat. No. 4,750,096. With reference to FIG. 5, it may be seen that a ballast, which may take the form of a toroidal ballast, and a reflector 20 may be connected to connecting element 16 and shell 14. Importantly, conductors 22, 23, 24 and 25, FIG. 4, extend from connecting element 16 and electrically connect to a PL fluorescent lamp. In the past, conductors 22, 23, 24, and 25 have been directly linked to a standard Edison base which is a male screw-in fitting. Thus, the prior art male screw-in fittings would also encourage the use of incandescent lamps absent the fluorescent screw-in fitting of the present invention. To obviate this eventuality, male fitting 26 is included. Male fitting 26 possesses a nonconducting portion 28 which may be of a ceramic material and the like. Non-conducting portion 28, FIG. 4, terminates in a male threaded surface 30 which is of non-standard size relative to lamp sockets. That is, male fitting 24 will not fit Edison standard Edison lamp sockets. Nonconducting portion 28 is afixed to the inner surface 32 of shell 14 by any suitable fastening means. In the embodiment shown in FIG. 4, glue or mastic, such as epoxy glue, is depicted as holding nonconducting portion 28 to shell 14. Conductors 22 and 24 connect to metallic ribbon 36 and end contact 38, respectively. It should be noted that metallic ribbon 36 is resilient in its construction. Metallic ribbon 36 and contact 38 are mounted to non-conducting portion 28 as shown in FIG. 4.

Figure 1:
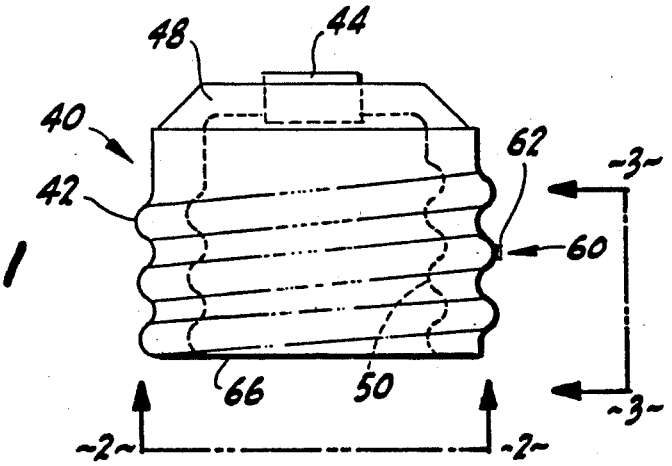
FIG. 1 is a side elevational view of the unit adaptor of the present invention, depicting the inner non-standard lamp socket and the inner end contact in phantom.
Figure 2:
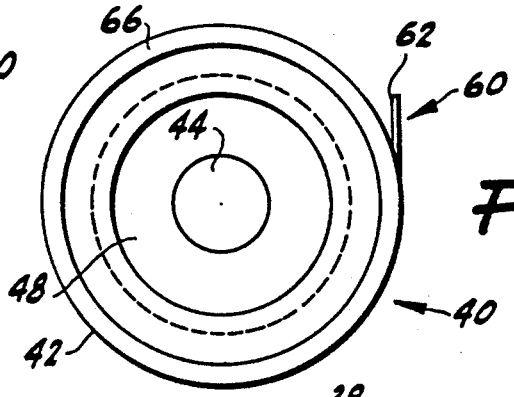
FIG. 2 is a view taken along 2—2 of FIG. 1.

The present system also includes an adaptor 40, FIG. 1, having threaded metallic outer surface 42 and an end contact 44. Adaptor 40 is intended fit within a standard Edison base 46, FIG. 5. Insulative portion 48 separates end contact 44 from threaded surface 62, FIG. 2, and also serves as an inner lamp socket 50 which is depicted in FIG. 1 as being threaded. It should be noted however, that inner lamp socket 50 may be a bayonnet or other type of electrical fitting. In this regard, male fitting 26 may include a bayonette structure, depicted in FIG. 6, where a pair of conductors 52 and 54 as well an end contact 56 are connected to an insulative portion 58. Contacts 52 and 54 may fit into a bayonette groove or other contact within lamp socket 50 (not shown) of adaptor 40.

Figure 3:
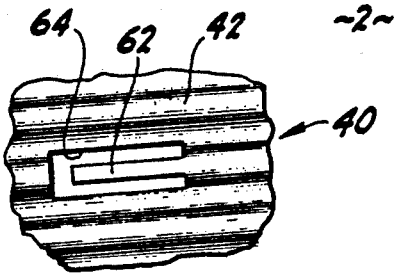
FIG. 3 is a view taken along 3—3 of FIG. 1.

Outer threaded surface 42 of adaptor 40 is of a standard size and includes locking means 60 for holding the same into standard Edison base 46. Locking means 60 includes a metallic finger of resilient configuration. Metallic finger extends from a slot 64 and outer threaded surface 42 of adaptor 40. Thus, metallic finger allows adaptor 40 to screw into Edison base 46 and may not be removed therefrom without breaking metallic finger 62, FIGS. 2 and 3.

Figure 6:
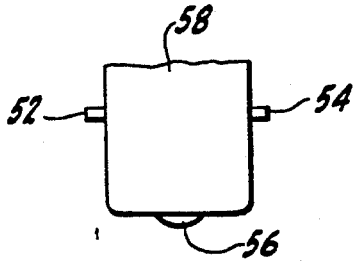
FIG. 6 is a side elevational view of a bayonette type structure of the male fitting used with the base member of the present invention.

In operation, male fitting 26 is attached to shell 14 which serves as a base member for a PL fluorescent lamp connecting element 16, FIG. 4. A ballast 18 and reflector 20 may also be included and fixed to connecting element 16, FIG. 5. Male fitting 26 is provided such that it may be fixed to shell 14 and include a male threaded surface 30 which is of a nonstandard size. Adaptor 40 is screwed into standard Edison base 46 and is locked therein by means 60. The lamp socket portion 50 of adaptor 40 accepts the male threaded surface 30 of nonconducting portion 28 of male fitting 26. As shown in FIG. 5, male fitting 26 screws into lamp sockets 50 of adaptor 40 such that contact 38 of male fitting 26 contacts end contact 44 of adaptor 40. Likewise, metallic ribbon 36 contacts the conducting edge 66 of threaded surface 42 of adaptor 40. Consequently, the PL lamp held to connecting element 16 makes electrical contact with Edison base 46. If base member 12 and connected male fitting 26 are removed from inner lamp socket 50 of adaptor 40, only a male fitting similar to male fitting 26 may be reinstalled in socket 50. That is to say, standard incandescent lamps may not be employed with installed adaptor 40. Of course, socket 50 and male fitting may be a bayonnet type or other electrical contact, such as depicted in FIG. 6.

While in foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A lighting system having a fluorescent lamp capable of screwing into a standard electrical lamp socket comprising;

a. a base member including a mechanism for mechanically and electrically connected to the fluorescent lamp, b. a male fitting including an outer surface;

c. connecting means for mechanically fixing said male fitting to said base member;

d. an adaptor capable of mechanically and electrically connecting to the standard electrical lamp socket said adaptor including an external threaded outer surface for threadingly engaging the standard electrical lamp socket to effect mechanical and electrical contact therewith, said adaptor further including an inner lamp socket capable of mechanically and electrically contacting said outer surface of said male fitting, said inner lamp socket of said adaptor being of a non-standard size; and e. locking means for preventing said adaptor from screwing out of the standard electrical lamp socket;

2. The lighting system of claim 1 in which said connecting means includes a flange extending from said male fitting outer surface, said base member includes a shoulder, and further includes fastening means for fixing said flange to said shoulder of said base member.

3. The lighting system of claim 2 in which said means for fixing said flange to said shoulder of said base comprises a glue.

4. The lighting system of claim 2 in which said male fitting outer surface is constructed of a ceramic material and said base member is constructed of a non-metallic material.

5. The lighting system of claim 1 in which said lighting unit further includes a reflector and an electrical ballast connected to said base member.

6. The lighting system of claim 1 in which said connecting means comprises a base member and male fitting formed as a unit.

7. The lighting system of claim 1 in which said inner lamp socket of said adaptor and said outer surface of said male fitting are threaded surfaces which threadingly engage one another.

8. The lighting system of claim 4 in which said adaptor external threaded surface is constructed of a metallic material.

* * * * *